US006022161A

United States Patent [19]

Choi

[11] Patent Number: 6,022,161

[45] Date of Patent: Feb. 8, 2000

[54] VARIABLE-LENGTH APPLICATOR

[76] Inventor: Man Soo Choi, Hyundai Apt. 301 - 502, Sa - Dong, Ans an - Shi, Kyungki-Do, 425-170, Rep. of Korea

[21] Appl. No.: 09/168,197

[22] Filed: Oct. 7, 1998

[30] Foreign Application Priority Data

Jun. 29, 1998 [KR] Rep. of Korea ..... 98-25144
Jul. 24, 1998 [KR] Rep. of Korea ..... 98-29928

[51] Int. Cl.[7] ..... B43K 5/16
[52] U.S. Cl. ..... 401/99
[58] Field of Search ..... 401/99, 115, 117, 401/66, 179

[56] References Cited

U.S. PATENT DOCUMENTS 1,865,325 6/1932 MacLeod ..... 401/179
4,778,300 10/1988 French et al. ..... 401/99

FOREIGN PATENT DOCUMENTS 8198 4/1903 United Kingdom ..... 401/99

*Primary Examiner*—David J. Walczak
*Attorney, Agent, or Firm*—Testa,Hurwitz & Thibeault, LLP

[57] ABSTRACT

A variable-length applicator which can extend and retract an applicator element by simple operation and does not require a separate cap. The invention comprises an inner housing, a power transmission part mounted in the inner housing, a first outer housing combined slidably on an outer circumference of an upper portion of the inner housing, a head part having a head fixed to an upper end of the first outer housing and a linear moving means fixed to a lower end of the head, the linear moving means being engaged with the power transmission part, a second outer housing fixed to outer circumference of lower portion of the inner housing, and a moving part mounted movably in the second outer housing, the moving part having a linear moving means engaged with the power transmission part opposite to the linear moving means of the head part and an applicator element fixed to the lower end of the linear moving means. With such an arrangement, a downward movement of the head part results in an upward movement of the applicator element.

9 Claims, 8 Drawing Sheets

VARIABLE-LENGTH APPLICATOR

BACKGROUND OF THE INVENTION

1. Field of the Invention

The present invention relates to a applicator, and more particularly to a variable-length applicator which can increase its length without any additional cap for user's convenience.

2. Description of the Prior Art

In general, a applicator for a makeup brush is consisted of a protective cap and body, and is used after separating a protective cap from a body. After using the applicator, the protective cap is combined to the body. However, since the applicator is constituted of the cap and the body separately, the cap may be lost during keeping and using the applicator. In case of losing the cap, a brush fixed at end of the body may damage, and especially, makeup powder on the brush may stain inside of a handbag.

Generally, a length of the applicator in use is longer than that of the pencil in keeping it. However, such increase in length of the applicator is generated due to a combination of the cap into a rear end of the body.

Another type applicator comprises a first housing in which a brush portion is received and a second housing used as a cap. A rod to which the brush portion is fixed is received in the first housing, and the upper portion of the rod is exposed through an opening formed at upper end of the first housing. This rod is received in the first housing without movement by a spring means. Also, another rod is fixed to inside of the second housing) used as a cap.

To use the applicator, the second housing is separated from a lower end of the first housing and combined to an upper end of the first housing. As a result, the rod fixed to inside of the second housing pushes the rod received in the first housing, therefore, the brush portion fixed to the lower end of the rod of the first housing is drawn out from the first housing.

To receive the brush portion into the first housing, the second housing is separated from the upper end of first housing so that the rod to which the brush portion is fixed returns to an initial position, therefore the brush portion is received in the first housing completely.

In the applicator as described above, there is also inconvenience in use because the second housing must be separated from the first housing to draw out the brush portion, and the second housing must be combined to the first housing to receive the brush portion drawn out into the first housing

SUMMARY OF THE INVENTION

Accordingly, it is the object of the present invention to provide a variable-length applicator which does not use additional cap and can receive/draw out a brush therein/therefrom by simple operation.

To achieve this objective, a length-variable type applicator of the present invention comprises an inner housing, a power transmission part mounted in the inner housing, a first outer housing combined slidably on outer circumference of upper portion of the inner housing, a head part having a head fixed to an upper end of the first outer housing and a linear moving means fixed to a lower end of the head, the linear moving means being engaged with the power transmission part, a second outer housing fixed to an outer circumference of a lower portion of the inner housing, and a moving part mounted movably in the second outer housing, the moving part having a linear moving means engaged with the power transmission part at opposite side to the linear moving means of the head part and an exposure portion fixed to a lower end of the linear moving means. Therefore, the moving means can be moved in the opposite direction to movement direction of the head part by the power transmission part when the head part is moved upward or downward.

The power transmission part of the present invention is consisted of a body having a channel formed at a lower portion thereof and a pinion mounted rotatably in said channel by a pin. The linear moving means of the head part and the moving part are racks meshed with the opposite portions of said pinion, respectively. Therefore, the racks of the head part and the moving part are moved in opposite direction from each other.

Another power transmission part of the present invention comprises a body having a channel formed at lower portion thereof and a plurality of pinions mounted rotatably in the channel by pins and meshed with each other. The number of said pinions is at least 3(three) and odd, an upper-most pinion and lower-most pinion are rotated in same direction and a diameter of upper-most and lower most pinions is longer than those of the pinions located between the upper-most and lower-most pinions. The linear moving means of the head part and the moving part are racks meshed with the opposite sides of the upper-most and lower-most pinions in initial position. Therefore, the racks of the head part and the moving part are moved in opposite direction from each other.

The applicator according to the another embodiment comprises in inner housing, a power transmission part mounted in the inner housing, a first outer housing combined slidably on outer circumference of a upper portion of the inner housing, a head part having a head fixed to an upper end of the first outer housing and a rod fixed to a lower end of the head and connected to the power transmission part, a second outer housing fixed to outer circumference of lower portion of the inner housing, and a moving part mounted movably in the second outer housing and having a rod connected to the power transmission part at opposite side to the rod of the head part and an exposure portion fixed to a lower end of the rod. Therefore, the moving means can be moved in the opposite direction to movement direction of the head part by the power transmission part where the head part is moved.

The power transmission part used in this embodiment comprises an upper and lower rollers mounted rotatably in the inner housing by pins fixed to the inner housing, respectively, and a belt of which a first and second protrusions are formed on outer surface of opposite sides. The upper and lower rollers are connected by the belt, the first protrusion is received in a recess formed at lower portion of the rod of the head part and the second protrusion is received in a recess formed at an upper portion of the rod of the moving part. Therefore, the rod of the head part and the rod of the moving part can be moved in opposite direction from each other.

BRIEF DESCRIPTION OF THE DRAWINGS

Other objects and advantages of the present invention will be understood by reading the detailed explanation of the embodiment with reference to the accompanying drawings in which.

DETAILED DESCRIPTION OF THE PREFERRED EMBODIMENTS

The First Embodiment

Figure 1A:
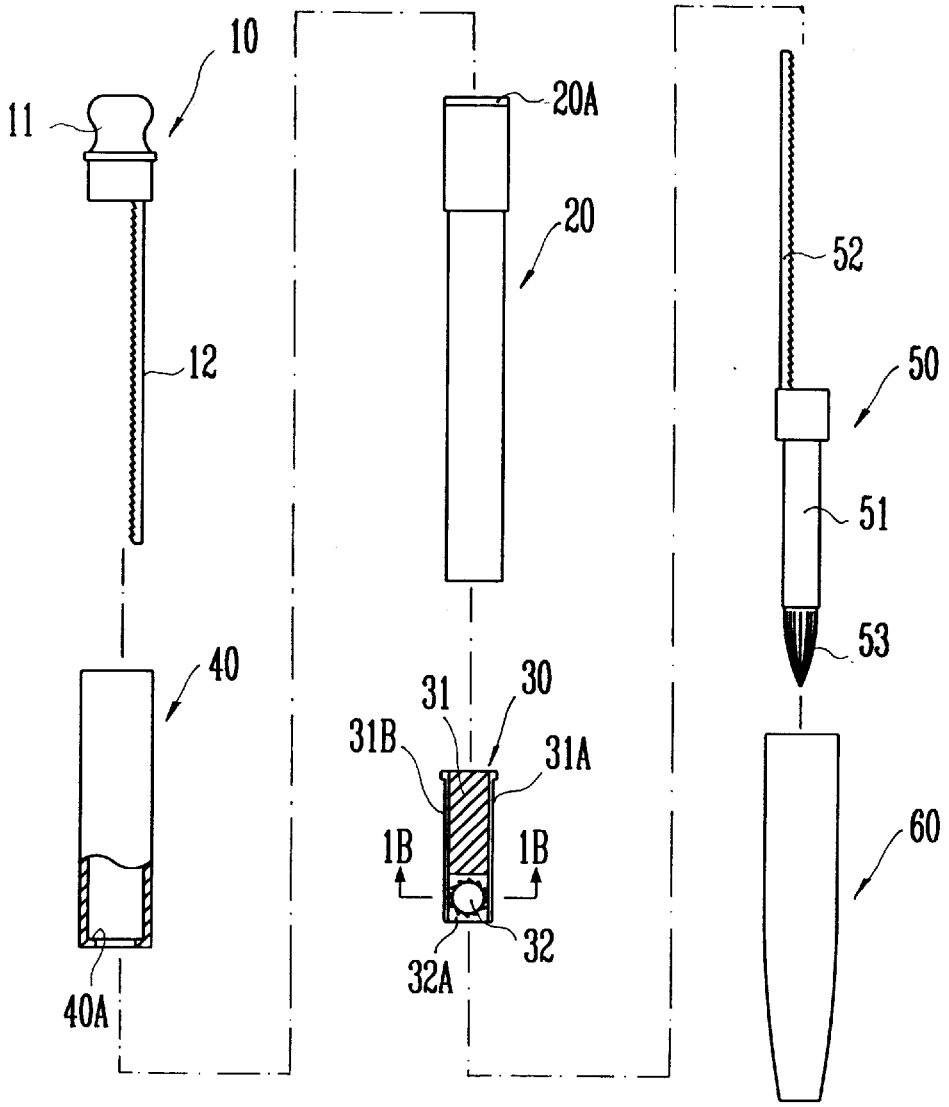
FIG. 1A is a view to for illustrating members used in the first embodiment of the present invention.

FIG. 1A is a view for illustrating members used in the first embodiment of the present invention, the present invention comprises a hollow inner housing 20, a first outer housing 40 located on an outer circumference of an upper portion of the inner housing 20 and a second outer housing 60 fixed to an outer circumference of a lower portion of the inner housing 20. The present invention further comprises a power transmission part 30 fixed in the inner housing 20, a head part 10 fixed to an upper portion of the first outer housing 40 and a moving part 50 received slidably in the second outer housing 60.

The first an outer housing 40 located on outer circumference of the inner housing 20 can be moved upwardly or downwardly along the inner housing 20. On an inner circumference of lower end of the first outer housing 40, a protrusion 40A is formed inwardly, and a protrusion 20A is formed outwardly on an outer circumference of upper end of the inner housing 20. Thus, although the first outer housing 40 is removed excessively upward, the first outer housing 40 can not be separated from the inner housing 20.

Figure 1B:
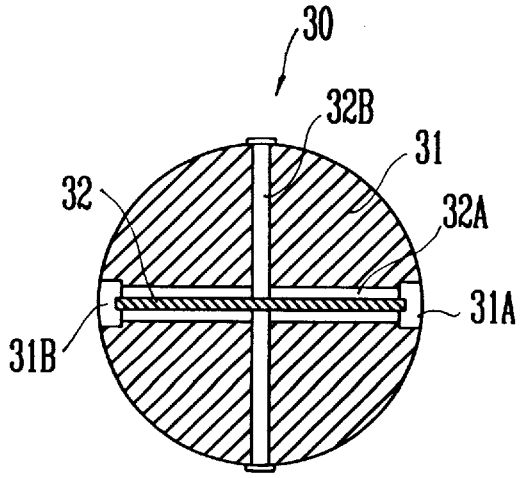
FIG. 1B is a sectional view taken along line 1B—1B of FIG. 1A and shows a power power transmission part.

The power transmission part 30 is fixed to an inside of the inner housing 20, and a detailed structure of the power transmission part 30 is shown in FIG. 1A and FIG. 1B.

The power transmission part 30 comprises a body 31 and a pinion 32 mounted in the body 31. A pinion receiving channel 32A is formed at a lower portion of the body 31 and the pinion 32 is mounted rotatably in the pinion receiving channel 32A by a pin 32B. On the other hand, first and second grooves 31A and 31B are formed at opposite sides of the body 31 along the whole height. The first and second grooves 31A and 31B are corresponded to both ends of the pinion receiving channel 32A, both sides of the pinion 32 mounted in the pinion receiving channel 32A are thus exposed through the first and second grooves 31A and 31B as shown in FIG. 1B.

The head part 10 fixed to the upper end of the first outer housing 40 comprises a head 11 and a rack 12 fixed to the head 11. When the first outer housing 40 to which the head part 10 is fixed is combined with the inner housing 20, the rack 12 is located in the first outer housing 40 and received in the first groove 31A formed at a side of body 31 of the power transmission part 30. In the first groove 31A, the rack 12 of the head part 10 is meshed with the pinion 32 received in the pinion receiving channel 32A.

The second outer housing 60 in which the moving part 50 is received is fixed to the lower end of the inner housing 20. The moving part 50 is consisted of a brush fixture 51 to which a brush 53 is fixed and a rack 52 fixed to top end of the brush fixture 51. When the second outer housing 60 in which a moving part 50 is received is fixed to an outer circumference of a lower end of the inner housing 20, the rack 52 is received in the second groove 31B formed at another side of body 31 of the power transmission part 30. In the second groove 31B, the rack 52 of the moving part 50 is meshed with the pinion 32 received in the pinion receiving channel 32A.

Figure 2:
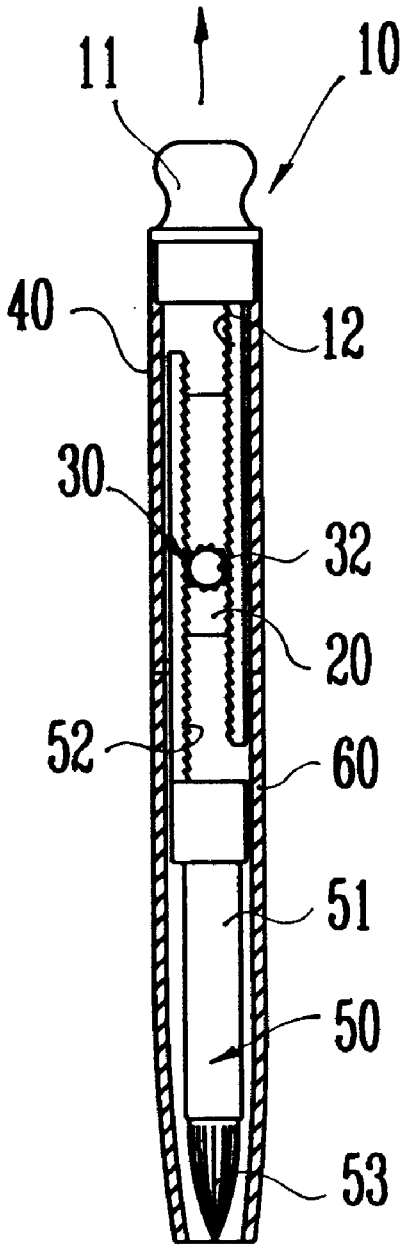
FIG. 2 is a sectional view for illustrating a state before use of the first embodiment of the present invention.

FIG. 2 is a sectional view for illustrating a state before use of the first embodiment of the present invention. As shown in FIG. 1A and FIG. 2, the rack 12 fixed to the head 11 of the head part 10 and the rack 52 fixed to the brush fixture 51 of the moving part 50 are meshed with both sides of the pinion 32, respectively. Therefore, when the pinion 32 is rotated, the rack 12 of the head part 10 and the rack 52 of the moving par, 50 are moved in opposite directions from each other. Also, since the rack 12 of the head part 10 and the rack 52 of the moving part 50 are received in the first and second grooves 31A and 31B, respectively, it is possible to make linear movement of the racks 12 and 52 without deviation from the pinion 32.

Operation of the first embodiment having a structure as described above will be described with reference to FIG. 1, FIG. 2, FIG. 3 and FIG. 4.

Figure 3:
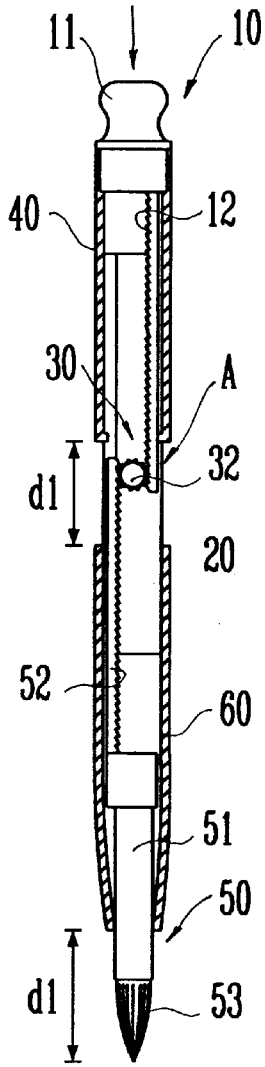
FIG. 3 is a sectional view for illustrating a state in use of the first embodiment of the present invention.
Figure 4:
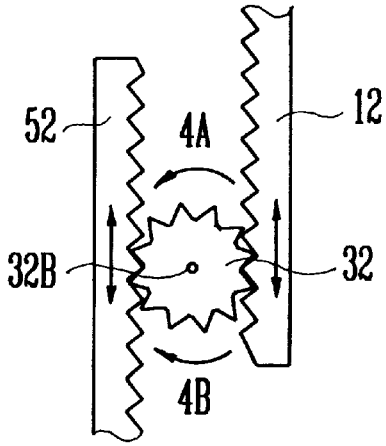
FIG. 4 is a detailed sectional view of "A" portion in FIG. 3.

FIG. 3 is a sectional view for illustrating a state in use of the first embodiment of the present invention and FIG. 4 is a detailed sectional view of "A" portion in FIG. 3. For convenience, the body of the power transmission part is not shown in FIG. 2, FIG. 3 and FIG. 4.

After combining the first outer housing 40 to which the head part 10 is fixed, the inner housing 20 in which the power transmission part 30 is received and the second outer housing 60 in which the moving part 50 is received, the head 11 of the head section 10 is pulled up to upward (based on FIG. 2), the first outer housing 40 is then moved upward along the inner housing 20.

Meanwhile, as described above, on an inner circumference of lower end of the first outer housing 40, the protrusion 40A is formed inwardly, and the protrusion 20A is formed outwardly on an outer circumference of upper end of the inner housing 20. If the first outer housing 40 is moved excessively to upward, the first outer housing 40 can not be separated from the inner housing 20 due to a contact of the protrusion 40A of the first outer housing 40 with the protrusion 20A of the inner housing 20.

When the rack 12 fixed on the head 11 is moved upwardly, the pinion 32 meshed with the rack 12 is rotated about the pin 32B in direction indicated by an arrow 4A in FIG. 4. Therefore, the rack 52 of the moving part 50, which is meshed with the pinion 32 at opposite side to the rack gear 12 of the head part 10, is moved in downwardly (that is, opposite direction to the rack 12 of the head part 10). Accordingly, the moving part 50 is moved to downward in the second outer housing 60, and some portion of the brush fixture 51 and the brush 53 of the moving part 50 are exposed to outside of the second outer housing 60.

Such operation is performed before engagement between the pinion 32 and the racks 12 and 52 is released. In FIG. 3, a moving distance of each of the racks 12 and or 52 from an initial position of FIG. 2 to a final position of FIG. 3 is indicated as d1.

As shown in FIG. 3, after such operation is completed, a length of the applicator is increased as much as feeding distances of the racks 12 and 52, that is, a length of the applicator is further increased as much as the length 2d1 which is a moving distance d1 of the first outer housing 40 added to the exposed length d1 of the brush fixture 51 and the brush 52 of the moving part 50.

After using the applicator, the head 11 of the head part 10 is pushed-down (based on FIG. 3) to receive the exposed brush fixture 51 and the brush 53 in the second outer housing 60, therefore, the first outer housing 40 is moved downwardly along the inner housing 20 and the rack 12 fixed to the head 11 is moved to downward. Therefore, the pinion 32 meshed with the rack 12 is rotated to a direction indicated by the arrow 4B in FIG. 4. As a result, the rack 52 of the moving part 50, meshed with the pinion gear 32, is moved to upward, that is, to the opposite direction to the rack 12 on the head section 10, and the exposed brush fixture 51 and the brush 52 are received in the second outer housing 60.

The Second Embodiment

Figure 5:
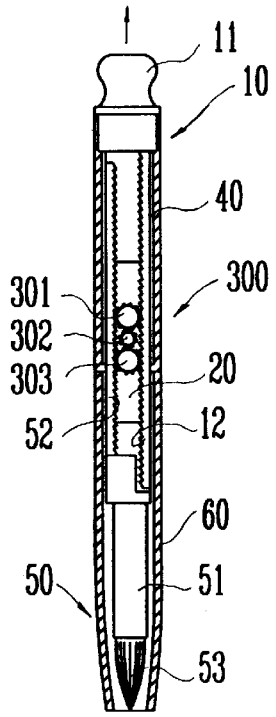
FIG. 5 is a sectional view for illustrating a state before use of the second embodiment of the present invention.
Figure 6:
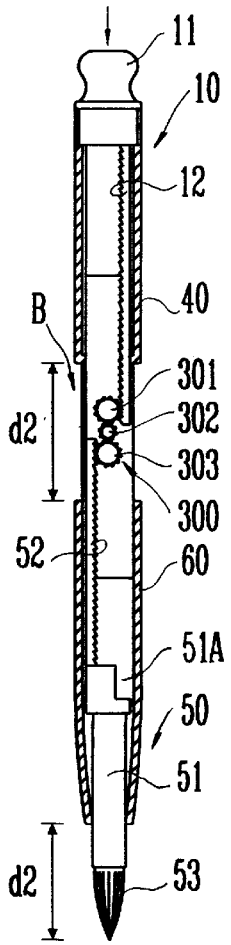
FIG. 6 is a sectional view for illustrating a state in use of the second embodiment of the present invention.
Figure 7:
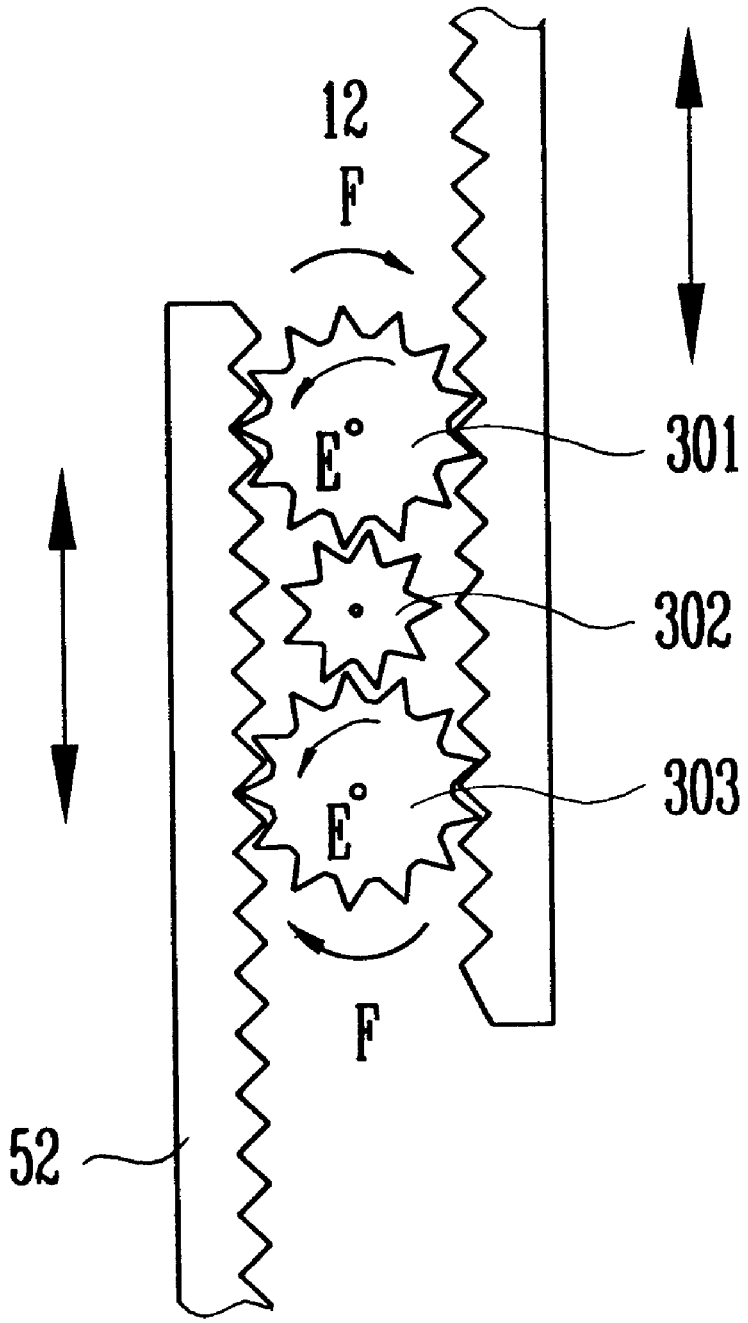
FIG. 7 is a detailed sectional view of "B" portion in FIG. 6.

FIG. 5 is a sectional view for illustrating a state before use the second embodiment of the present invention, FIG. 6 is a sectional view for illustrating a state in use of the second embodiment of the present invention and FIG. 7 is a detailed sectional view of "B" portion in FIG. 6.

The most important characteristic of the second embodiment is structure of a power transmission part 300. The power transmission part 300 comprises a body (31 as shown in FIG. 1A,) and three pinions 301, 302 and 303 mounted in the pinion receiving channel (32A as shown in FIG. 1B).

The first, second and third pinions 301, 302 and 303 are mounted rotatably in the pinion receiving channel by the pins (not shown) and meshed with from each other. Therefore, the first and third pinions 301 and 303 are rotated in same direction as shown in FIG. 7 Also, a diameter of each of the first and third pinions 301 and 303 is longer than that of the second pinion 302 located between the first and third pinions 301 and 303.

In combining the first outer housing 40 to which the head part 10 is fixed, the inner housing 20 in which the power transmission part 300 is received and the second outer housing 60 in which the moving part 50 is received, as shown in FIG. 5, the rack 12 fixed to the head 11 and received in the first groove (31A of the body 31 as shown in FIG. 1A) are meshed with the first pinion 301 as upper pinion and the third pinion 303 as a lower pinion, simultaneously. Also, the rack 52 fixed to the brush fixture 51 and received in the second groove (31B of the body 31 as shown in FIG. 1A) opposite to the first groove (31A of FIG. 1A) are meshed with the first pinion 301 and the third pinion 303, simultaneously. The second pinion 302 is not meshed with the racks 12 and 51, and is rotated in response to the rotation of the first and third pinions 301 or 303.

Although the only three pinions 301, 302 and 303 are shown and described in FIG. 5, FIG. 6 and FIG. 7, the number of the pinions may be at least 3 (three) and should be odd so that the upper-most pinion and lower-most pinion are rotated in same direction. Also, a diameter of upper-most and lower most pinions is longer than those of the pinions located between the upper-most and lower most pinions.

Operation of the second embodiment having a structure as described above will be described with reference to FIG. 5, FIG. 6 and FIG. 7.

After combing the first outer housing 40 to which the head part 10 is fixed, the inner housing 20 in which the power transmission part 300 is received, and the second outer housing 60 in which the moving part 50 is received, the head 11 of the head section 10 is pulled up to upward (based on FIG. 5), the first outer housing 40 is then moved upward along the inner housing 20.

When the rack 12 fixed to the head 11 is moved upwardly, the first and third pinions 301 and 303 meshed with the rack 12 are rotated in same direction indicated by an arrow E in FIG. 7. Therefore, the rack 52 of the moving part 50, which is meshed with the first and third pinions 301 and 303 at an opposite side of the rack 12 of the head part 10, is moved downwardly (that is, opposite direction to the rack 12 of the head part 10). Accordingly, the moving part 50 is moved to downward in the second outer housing 60, and some portion of the brush fixture 51 and the brush 53 of the moving part 50 are exposed to outside of the second outer housing 60.

Meanwhile, as shown in FIG. 6, even though an engagement between the rack 12 and the third (lower-most) pinion 303 is released, an engagement between the rack 12 and the first (upper-most) pinion 301 maintains. Also, even if an engagement between the rack 52 and the first (upper-most ) pinion 301 is released, an engagerrient between the rack 52 and the third (lower-most) pinion 303 maintains. Therefor, although the engagement between the rack 12 and the third pinion 303 and the engagement between the rack 52 and the first pinion 301 are released, if the rack 12 of the head part 10 is moved continuously upward, the first pinion 301 is rotated continuously. The second pinion 302 is rotated in response to a rotation of the first pinion 301 and the third pinion 303 is rotated in response to a rotation of the second pinion 302. Consequently, the movement of the moving part 50 is performed after engagement between the third pinion 303 and the rack 12 of the head part 10 and after engagement between the first pinion 301 and the rack 52 of the moving part 50 are released.

In FIG. 6, a moving distance of each of the racks 12 and 52 from an initial position of FIG. 5 to a final position of FIG. 6 is indicated as d2.

As shown in FIG. 6, after such operation is completed, a length of the pencil is increased as much as moving distances of the racks 12 and 52, that is, a length of the pencil is increased as much as the length 2d2 which is a moving distance d2 of the first outer housing 40 added to the exposed length d2 of the brush fixture 51 and the brush 53 of the moving part 50.

After using the applicator, the head 11 of the head part 10 is pushed-down (based on FIG. 6) to receive the exposed brush fixture 51 and the brush 53 in the second outer housing 60, the first outer housing 40 is moved downwardly along the inner housing 20 and the rack 12 fixed to the head 11 is moved to downward. Therefore, the first pinion 301 meshed with the rack 12 is rotated to a direction indicated by the arrow F in FIG. 7. As a result, the second pinion 302 is rotated in opposite direction to rotation direction of the first pinion 301 and the third pinion 303 is rotated in same direction with the first pinion 301. The rack 52 of the moving part 50, which is meshed with the third pinion 303, is moved to upward, that is, to the opposite direction to the rack 12 of the head section 10, and the exposed brush fixture 51 and the brush 55 are received in the second outer housing 60. (A reference numeral 51A not mentioned is groove formed on the brush fixture 51 to receive a lower portion of the rack 12 of the head part 10 at initial position of FIG. 5)

Comparing with the first embodiment, the second embodiment has the following differences.

If the same racks 12 and 52 used in the first embodiment are used in the second embodiment, the exposed length d2 of the moving part 50 can be maximized by the plurality of pinions 301, 302 and 303. That is, the racks 12 and 52 must be meshed with the pinion 32 continuously in the first embodiment. However, in the second embodiment, the moving part 50 can be moved downward before engagement between the third pinion 303 and the rack 12 of the head part 10 and before engagement between the first pinion 301 and the rack 52 of the moving part 50 therefore, the maximum moving distance of the moving part 50 is increased relatively. As a result, the entire length of pencil in the second embodiment in use is longer than that of the pencil in first embodiment in use.

The Third Embodiment

Figure 8:
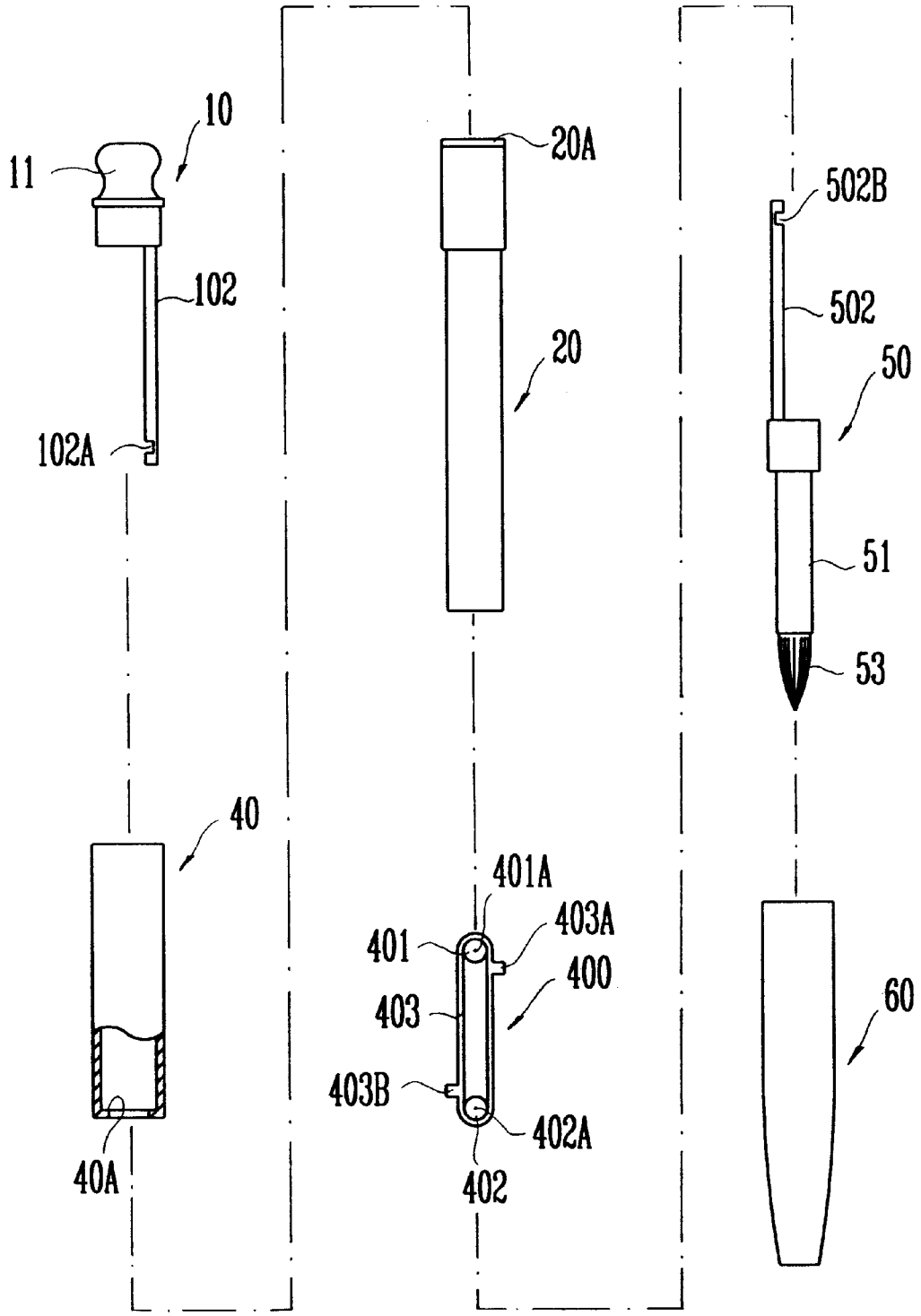
FIG. 8 is a view to for illustrating members used in the third embodiment of the present invention.
Figure 9:
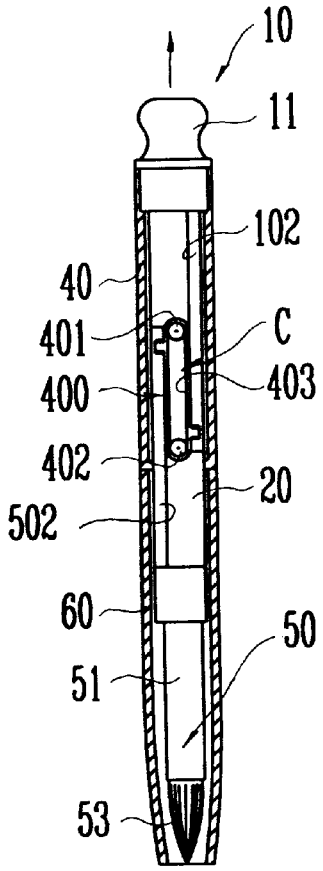
FIG. 9 is a sectional view for illustrating a state before use of the third embodiment of the present invention.
Figure 10:
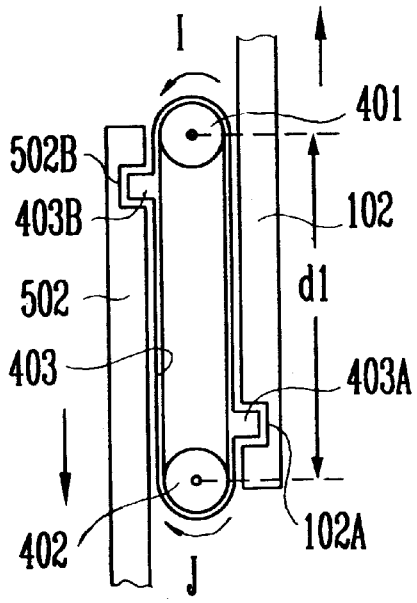
FIG. 10 is an enlarged view of "C" portion in FIG. 8.
Figure 11:
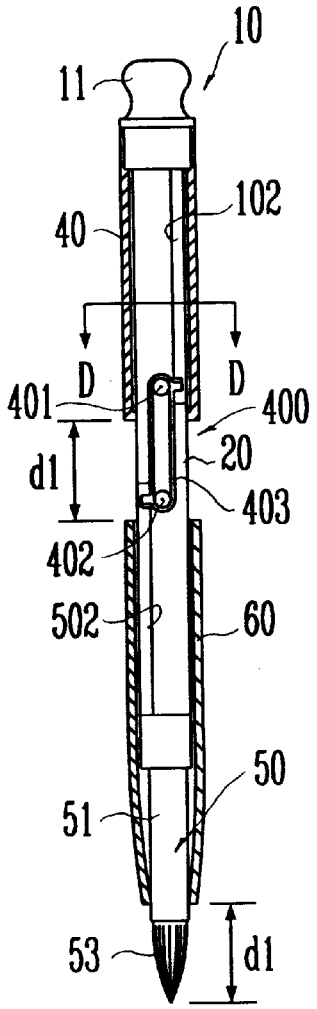
FIG. 11 is a sectional view for illustrating a state in use of the third embodiment of the present invention.

FIG. 8 is a view to for illustrating members used in the third embodiment of the present invention, FIG. 9 is a sectional view for illustrating a state before use of the third embodiment of the present invention, FIG. 10 is an enlarged view of "C" portion in FIG. 9 and FIG. 11 is a sectional view for illustrating a state in use of the third embodiment of the present invention.

The third embodiment of the present invention also comprises a hollow inner housing 20, a first outer housing 40 located on an outer circumference of upper portion of the inner housing 20 and a second outer housing 60 fixed to a circumference of lower portion of the inner housing 20, a head part 10 fixed to an upper portion of the first outer housing 40 and a moving part 50 received slidably in the second outer housing 60.

The first outer housing 40 located on outer circumference of the inner housing 20 can be moved upwardly or downwardly along the inner housing 20. On an inner circumference of lower end of the first outer housing 40, a protrusion 40A is formed inwardly, and a protrusion 20A is formed outwardly on an outer circumference of upper end of the inner housing 20. Thus, although the first outer housing 40 is moved excessively to upward, the first outer housing 40 can not be separated from the inner housing 20.

The most important characteristic of the third embodiment is structure of a power transmission part 400 located in the inner housing 20. The power transmission part 400 comprises an upper and lower rollers 401 and 402 mounted in the inner housing. Each of the rollers 401 and 402 can be rotated about each of pins 401A, and 402A, respectively. Both ends of the pins 401A and 402A are fixed to the inner housing 20 and both pins 401A and 402A are spaced from each other.

The power transmission part 400 further comprises a belt 403 of which a first and second protrusions 403A and 403B are formed on outer surface. The first and second protrusions 403A and 403B are opposite from each other. The upper and lower rollers 401 and 402 are connected by the belt 403.

The head part 10 fixed to the upper end of the first outer housing 40 comprises a head 11 and a rod 102 fixed to a lower end of the head 11. When the first outer housing 40 to which the head part 10 is fixed is combined with the inner housing 20, the rod 102 is received in the first outer housing 40. A recess 102A is formed at a side of lower portion of the rod 102A.

The second outer housing 60 in which the moving part 50 is received is fixed to the lower portion of the inner housing 20. The moving part 50 is consisted of a brush fixture 51 and a brush 53 fixed to the lower end of the brush fixture 51. A rod 502 is fixed to top end of the brush fixture 51. A recess 502B is formed at a side of upper portion of the rod 502.

When the first outer housing 40 to which the head part 10 is fixed, and the inner housing 20 in which the power transmission part 400 is mounted and the second outer housing 60 in which the moving part 50 is received is are assembled as shown in FIG. 9, the recess 102A of the rod 102 of the head part 10 receives the first protrusion 403A of the belt 403 and the recess 502B of the rod 502 of the moving part 10 receives the second protrusion 403B of the belt 403.

To draw-out the brush 53 of the moving part 50 from the second outer housing 60, the head 11 is pulled-up as shown in FIG. 9 and the rod 12 is then moved upwardly. Since the first protrusion 403A formed on the belt 403 is received in the recess 102A of the rod 102, the belt 403 is moved in direction indicated by an arrow I in FIG. 10 in response to the movement of the rod 102. Therefore, the rod 502 of the moving part 50 is moved downwardly by the movement of the belt 403 since the recess 502B of the moving part 50 receives the second protrusion 403B formed on the belt 403. As a result, the moving part 50 is moved downwardly in the second outer housing 60 and the brish 53 is exposed to outside of the second outer housing 60 as shown in FIG. 11.

Meanwhile, at initial position, that is, the first outer housing 40 and the second outer housing 60 are contacted from each other on the inner housing 20 as shown in FIG. 9, the first protrusion 403A received in the recess 102A of the rod 102 is adjacent to the lower roller 402 and the second protrusion 403B received in the recess 502B of the rod 502 is adjacent to the upper roller 401. Therefore, a moving distance of the head part 10 and the moving part 50 can be maximized when a distance between the upper and lower rollers 401 and 402 is limited.

Although the rods 102 and 502 have the only one recess, respectively, and the belt 403 has the two protrusion 403A and 403B received in the recesses 102A and 502B, respectively, however, the number of the protrusion and recess is not limited. To transmit a power applied to the head 11 to the moving part 50 exactly, a plurality of recesses are formed on surface of the rods 102 and 502 at regular interval and a plurality of protrusions, which will be received in the recesses one by one, are formed on outer surface of the belt 403 at regular interval such as a timing belt.

As shown in FIG. 11, after a drawn-out operation is completed as described above, an entire length of the pencil is further increased as much as twice of a maximum moving distance d1 (distance between the pins 401A and 402A) of the each protrusion 403A and 403B, that is, a length 2d1 which is a moving distance d1 of the First outer housing 40 added an exposed length d1 of the brush 53 of the moving part 50.

To receive the exposed brush 53 into the second outer housing 60 after the applicator is used, the head 11 of the head part 10 is pushed down, the first outer housing 40 is then moved downwardly along the inner housing 20. At same time, the first protrusion 403A received in the recess 102A of the rod 102 is moved downwardly, therefore, the belt 403 is fed in a direction by arrow J of FIG. 10. As a result, the rod 502 whose the recess 502B receives the second protrusion 403B of the belt 403 is moved to upward and the moving part 50 is moved upwardly so that the exposed brush 53 is received in the second outer housing 60.

Figure 12:
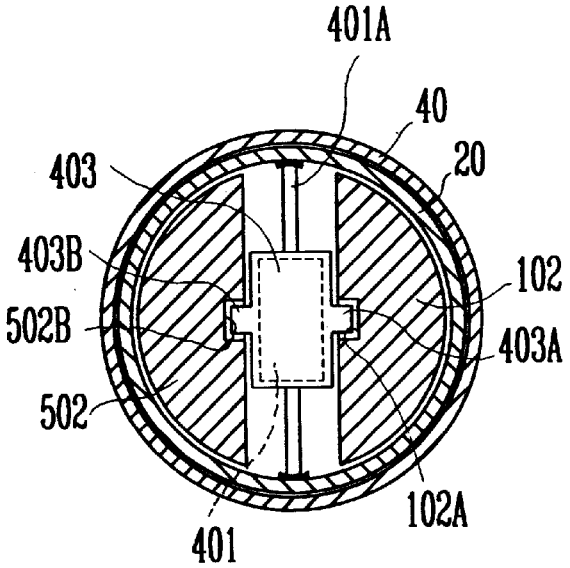
FIG. 12 is a sectional view taken along line D—D of FIG. 11 and shows a power power transmission part. Similar reference characteristics refer to similar parts throughout the several views of the drawings.

FIG. 12 is a sectional view taken along line D—D of FIG. 11 and shows the belt 403 wrapped on the upper roller 401 which is mounted rotatably in the inner housing 20 by the pin 401A. Also, FIG. 12 shows the relation between the rod 102 of the head part 10 and the belt 403 and between the rod 502 of the moving part 50 and the belt 403.

In the present invention as described above, the brush is exposed to outside of the outer housing and an entire length of the applicator is increased by a pulling the head simply.

Also, the exposed brush is received in the outer housing and an entire length of the applicator is decreased by a pushing the head simply so that user can achieve the convenience for using the applicator.

The above embodiments take example by a applicator for makeup, but may apply to writing tools such as ballpoint pens, of course.

The foregoing description, although described in its preferred embodiments with a certain degree of particularity, is only illustrative of the principle of the present invention. It is to be understood that the present invention is not to be limited to the preferred embodiments disclosed and illustrated herein. Accordingly, all expedient variations that may be made within the scope and spirit of the present invention are to be encompassed as further embodiments of the present invention.

What is claimed is:

1. A variable-length applicator, comprising;

an inner housing;

a power transmission part mounted in said inner housing, said power transmission part comprising a body having a channel formed at a lower portion thereof and a pinion mounted rotatably in said channel;

a first outer housing mounted slidalby within an outer circumference of an upper portion of said inner housing;

a head part having a head fixed to an upper end of said first outer housing and a linear moving means fixed to a lower end of said head, said linear moving means being engaged with said power transmission part;

a second outer housing fixed to outer circumference of lower portion of said inner housing; and a moving part mounted movably in said second outer housing, said moving part having (i) a linear moving means engaged with said pinion of said power transmission part and opposed to said linear moving means of said head rart and (ii) an exposure portion fixed to the lower end of said linear moving means of said moving part, whereby said moving part can be moved in a direction opposite to a movement direction of said head part.

2. The variable-length applicator of claim 1, wherein said first outer housing has a protrusion formed inwardly on an inner circumference of lower end thereof, and said inner housing has a protrusion formed outwardly on an outer circumference of upper end thereof, whereby said first outer housing can not be separated from said inner housing.

3. The variable-length applicator of claim 1, wherein said body of said power transmission part has a first and second grooves formed at opposite sides thereof along the entire length and corresponded to both sides of said channel, whereby said racks of said head part and said moving part are received in said first and second grooves, respectively.

4. The variable-length applicator of claim 1, wherein said power transmission part comprises a body having a channel formed at lower portion thereof and a plurality of pinions mounted rotatably in said channel by pins and meshed with each other;

wherein the number of said pinions is at least 3 (three) and odd, wherein an upper-most pinion and lower-most pinion are rotated in the same direction and a diameter of upper-most and lower most pinions is longer than those of said pinions located between said upper-most and lower-most pinions, wherein said linear move means of said head part and said moving part are racks meshed with and opposed to said upper-most and lower-most pinions in an initial position, whereby said racks of said head part and said moving part are moved in opposite direction from each other.

5. A variable-length applicator, comprising:

an inner housing;

a power transmission part mounted in said inner housing;

a first outer housing mounted slidably with an outer circumference of upper portion of said inner housing;

a head part having a head fixed to an upper end of said first outer housing and a rod fixed to a lower end of said head, said rod connected to said power transmission part;

a second outer housing fixed to outer circumference of lower portion of said inner housing; and a moving part mounted movably in said second outer housing, said moving part having a rod connected to said power transmission part at opposite side to said rod of said head part and an exposure portion fixed to lower end of said rod, whereby said moving part can be moved in the opposite direction to movement direction of said head part by said power transmission part when said head part is moved, wherein said power transmission part comprising upper and lower rollers mounted rotatably in said inner housing by pins fixed to said inner housing, respectively, and a belt of which a first and second protrusions are formed on outer surface of opposing sides of said belt, wherein said upper and lower rollers are connected by said belt, said first protrusion is received in a recess formed at lower portion of said rod of said head part and said second protrusion is received in a recess formed at upper portion of said rod of said moving part, whereby said rod of said head part and said rod of said moving part are moved in opposite direction for each other.

6. The variable-length applicator of claim 5, wherein said first outer housing has a protrusion formed inwardly on an inner circumference of lower end thereof, and said inner housing has a protrusion formed outwardly on an outer circumference of upper end thereof, whereby said first outer housing can not be separated from said inner housing.

7. A length-variable type applicator comprising;

an inner housing;

a power transmission part mounted in said inner housing, said power transmission part comprising a body having a channel formed at a lower portion thereof and a plurality of pinions mounted rotatably in said channel and meshed from each other, wherein a number of said pins is at least 3 (three) and odd, an upper-most pinion and lower-end pinion are rotated in same direction and a diameter of said upper-most and lower-most pinion is longer than those of said pinions located between said upper-most and lower-most pinions;

a first outer housing receiving an upper portion of said inner housing;

a head part having a head fixed to an upper end of said first outer housing and a rack fixed to lower end of said head, said rack being engaged with a side of said upper-most and lower-most pinions;

a second outer housing fixed to an outer circumference of a lower portion of said inner housing; and a moving part mounted moveable in said second housing, said moving part having a rack engaged with upper-most and lower-most pinions at an opposite side to said rack of said head part and an exposures portion fixed to a lower end of said rack, whereby said moving part can moved in the opposite direction to movement direction of said head part by said pinions when said head part is moved upward or downward.

8. The variable-length type applicator of claim 7, wherein said first outer housing has a protrusion formed inwardly on an inner circumference of a lower end thereof, and said inner housing has protrusion formed outwardly on an outer circumference of an upper end thereof, whereby said first outer housing can not be separated from said inner housing.

9. The variable-length type applicator of claim 7, wherein said body of said power transmission part has first and second grooves formed at opposite sides thereof along the entire length and corresponded to both sides of said channel, whereby said racks of said head part and said moving part are received in said first and second grooves, respectively, for guiding said racks.

* * * * *

UNITED STATES PATENT AND TRADEMARK OFFICE

CERTIFICATE OF CORRECTION

PATENT NO.: 6,022,161
DATED: February 8, 2000
INVENTOR: Choi

It is certified that error appears in the above-identified patent and that said Letters Patent is hereby corrected as shown below:

Column 9, claim 1, line 24, delete "slidalby", insert ---slidably---:

Column 9, claim 1, line 38, delete "rart", insert ---part---

Signed and Sealed this

Twenty-first Day of November, 2000

*Attest:*

Q. TODD DICKINSON

*Attesting Officer*

*Director of Patents and Trademarks*